United States Patent [19]

Randolph

[11] 4,109,335

[45] Aug. 29, 1978

[54] SHOE SUPPORT APPARATUS

[76] Inventor: Robert C. Randolph, 2300 19th St., NW., Washington, D.C. 20009

[21] Appl. No.: 776,361

[22] Filed: Mar. 10, 1977

[51] Int. Cl.[2] ..... A43D 3/14; A47L 23/18

[52] U.S. Cl. ..... 12/123; 15/267; 211/35

[58] Field of Search ..... 15/265, 267; 12/123, 12/125; 211/35, 38

[56] References Cited

U.S. PATENT DOCUMENTS

| | | | |
|---|---|---|---|
| 751,036 | 2/1904 | Wichman | 211/35 UX |
| 890,131 | 6/1908 | Fischer | 15/267 UX |
| 963,140 | 7/1910 | Hackett | 12/124 |
| 1,436,607 | 11/1922 | Roberts | 15/267 |
| 1,538,309 | 5/1925 | Thackeray et al. | 15/265 |
| 2,349,106 | 5/1944 | Mullan | 15/265 |
| 2,416,587 | 2/1947 | Lyngby | 12/123 |

*Primary Examiner*—Daniel Blum

*Attorney, Agent, or Firm*—Lowe, King, Price & Markva; Lowe, King, Price & Markva

[57] ABSTRACT

Shoe support apparatus, particularly for supporting a shoe thereon during the performance of a shoe shining operation, is disclosed. A base panel is adapted to be secured to a vertical support surface, such as, for example, a wall or a door. A shoe support member is pivotably mounted adjacent the lower portion of the panel. A shoe retaining assembly is pivotally mounted adjacent the upper portion of the panel and comprises three relatively movable sections including a shoe tree structure. The sections are connected by unique pivot joints formed of integral parts of said sections, and are so arranged as to define an over-center type locking mechanism. In this manner, the apparatus is able to be collapsed for storage and quickly erected and locked for rigidly supporting the shoe during a shoe polishing operation.

13 Claims, 3 Drawing Figures

Fig. 2
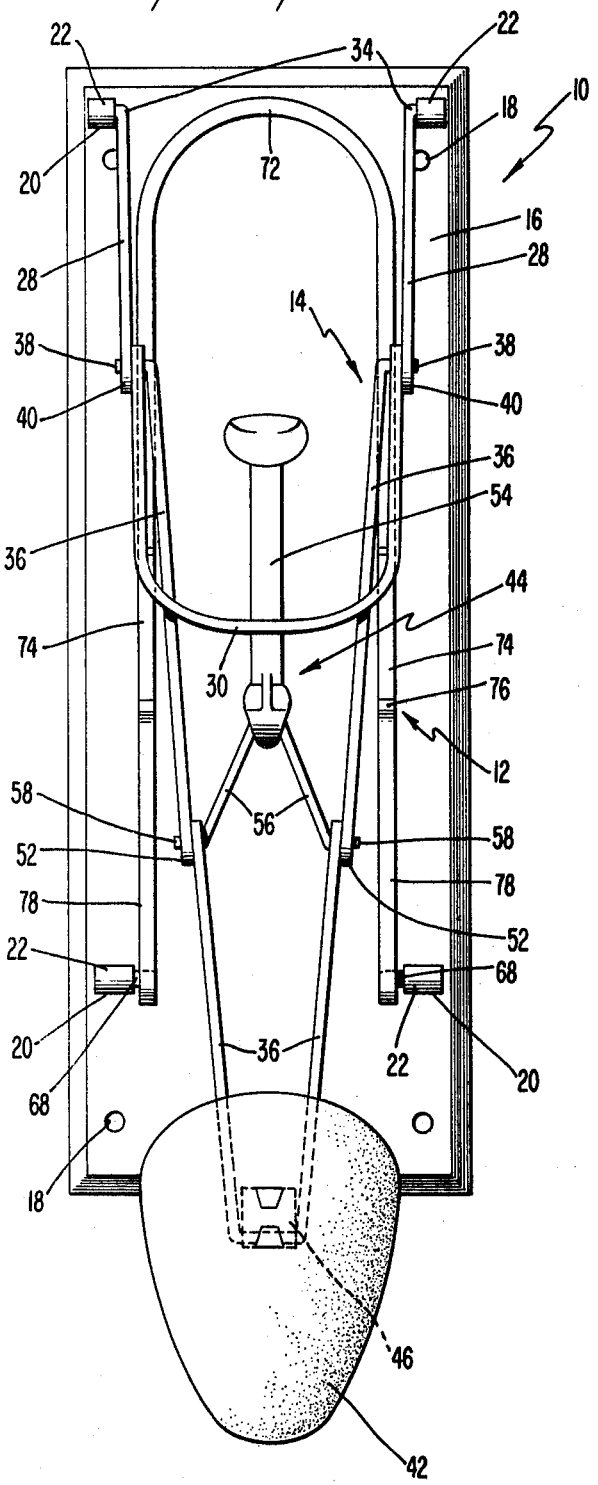
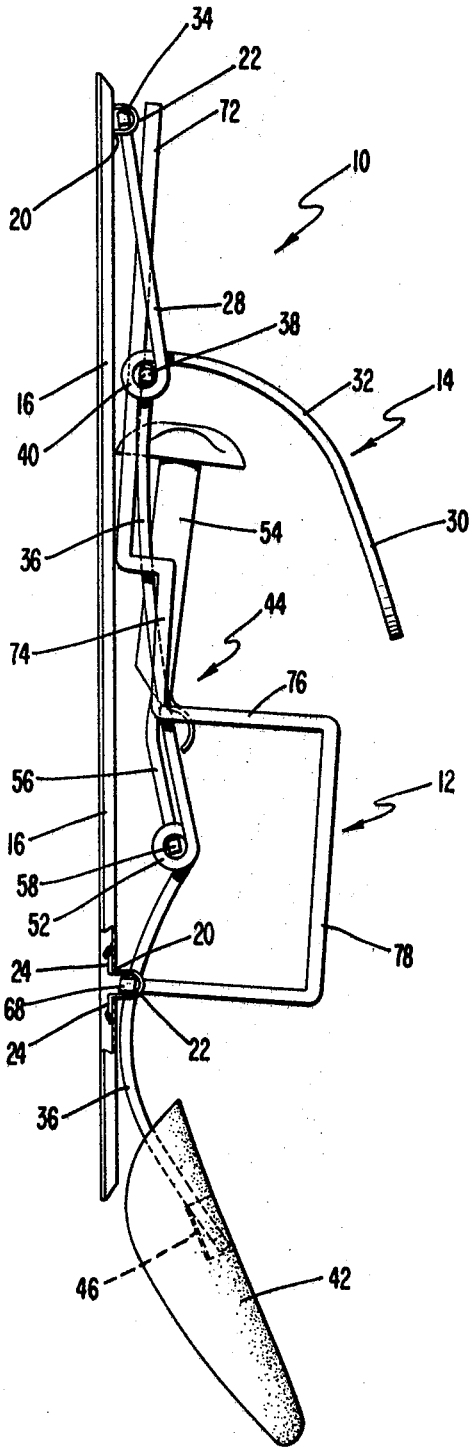
Fig. 3

SHOE SUPPORT APPARATUS

FIELD OF THE INVENTION

The present invention relates generally to shoe support apparatus, and more particularly, to an improved apparatus for rigidly supporting a shoe thereon so as to facilitate a shoe shining operation.

BACKGROUND OF THE INVENTION

While many different types of shoe racks or support apparatus are known in the prior art, insofar as I am aware, there has never been a successful mechanical support apparatus for stretching and holding shoes steady while shining. My previous design patents, U.S. Pat. Nos. D-237,120 and D-237,119, issued Oct. 7, 1975, represent the best efforts to date to provide a commercial apparatus for this purpose.

The shortcoming of my previous design was found to be mainly in the apparatus being too expensive to manufacture. The parts by their nature were required to be made of expensive tubing stock and intricate stampings stampings and castings. In addition, a desirable attribute was recognized to be the capability of folding all parts substantially flat when not in use, while at the same time, locking in position when erected. Simplicity in concept and ruggedness in design were also soon recognized as being essential and not found in my previous designs.

OBJECTIVES OF THE INVENTION

Accordingly, it is an object of the present invention to provide a new and improved shoe support apparatus that is economical to manufacture.

Another object of the present invention is to provide a new and improved shoe support apparatus with mechanical features to overcome the various disadvantages characteristic of prior art shoe support apparatus, as described.

Still another object of the present invention is to provide a new and improved shoe support apparatus which will rigidly support shoes and is rugged for extended life.

Yet another object of the present invention is to provide a new and improved shoe support apparatus comprising a locking retaining assembly with shoe tree structure for not only holding the shoe but also properly stretching the shoes mounted thereon so as to facilitate the performance of a shoe polishing operation.

Still another object of the present invention is to provide a new and improved shoe support apparatus providing for the convenient storing when not in use.

A further object of the present invention is to provide a new and improved shoe support apparatus which is simplistic in structure and capable of being easily mounted upon, or removed from, its support surface.

A further object of the present invention is to provide a new and improved shoe support apparatus which is relatively simple in that the major interfitting functional component parts are fabricated by simply bending rod stock.

Another object of the present invention is to provide a new and improved shoe support apparatus which is relatively light in weight, and yet is durable in service.

BRIEF DESCRIPTION OF THE INVENTION

The shoe support apparatus of the present invention comprises a base panel upon which an upper retaining assembly and a lower shoe support member are pivotably mounted. The base panel is adapted to be mounted upon a vertical support surface, such as, for example, a wall or door. Alternatively, a stand for a table top model may be provided. The retaining assembly includes a shoe tree structure to stretch the shoe, as it also functions to hold the shoe in position.

The retaining assembly and the support member are both fabricated from somewhat flexible and resilient, metal rod stock and the interconnecting pivot joints are integrally formed therefrom. The lower shoe support member serves as a platform upon which a shoe is to be mounted. The upper retaining assembly with the shoe tree structure is self-adjusting to a relatively wide range of shoe sizes. This is accomplished by the flexibility of the component parts of the retaining assembly.

As a result of the pivotable mounting of the retaining assembly and the shoe support member upon the base panel, the apparatus may alternatively be collapsed for storage or erected for supporting a shoe thereon. In addition, in view of the flexibility and resiliency of the metal rod stock, as well as the relative disposition of the pivot joints of the retaining assembly, an over-center locking mechanism is also defined within the apparatus. This locking mechanism serves to retain the apparatus within a rigid mode of its erected state for securely supporting a shoe during the performance of a shoe polishing operation.

Still other objects and advantages of the present invention will become readily apparent to those skilled in this art from the following detailed description, wherein I have shown and described only the preferred embodiment of the invention, simply by way of illustration of the best mode contemplated by me of carrying out my invention. As will be realized, the invention is capable of other and different embodiments, and its several details are capable of modification in various obvious respects, all without department from the invention. Accordingly, the drawings and description are to be regarded as illustrative in nature, and not as restrictive.

BRIEF DESCRIPTION OF THE DRAWINGS

FIG. 2 is a front elevation view of the apparatus of FIG. 1, showing the apparatus in a collapsed, storage mode; and FIG. 3 is a side elevation view of the apparatus of FIG. 2.

DETAILED DESCRIPTION OF THE PREFERRED EMBODIMENT

Figure 1:
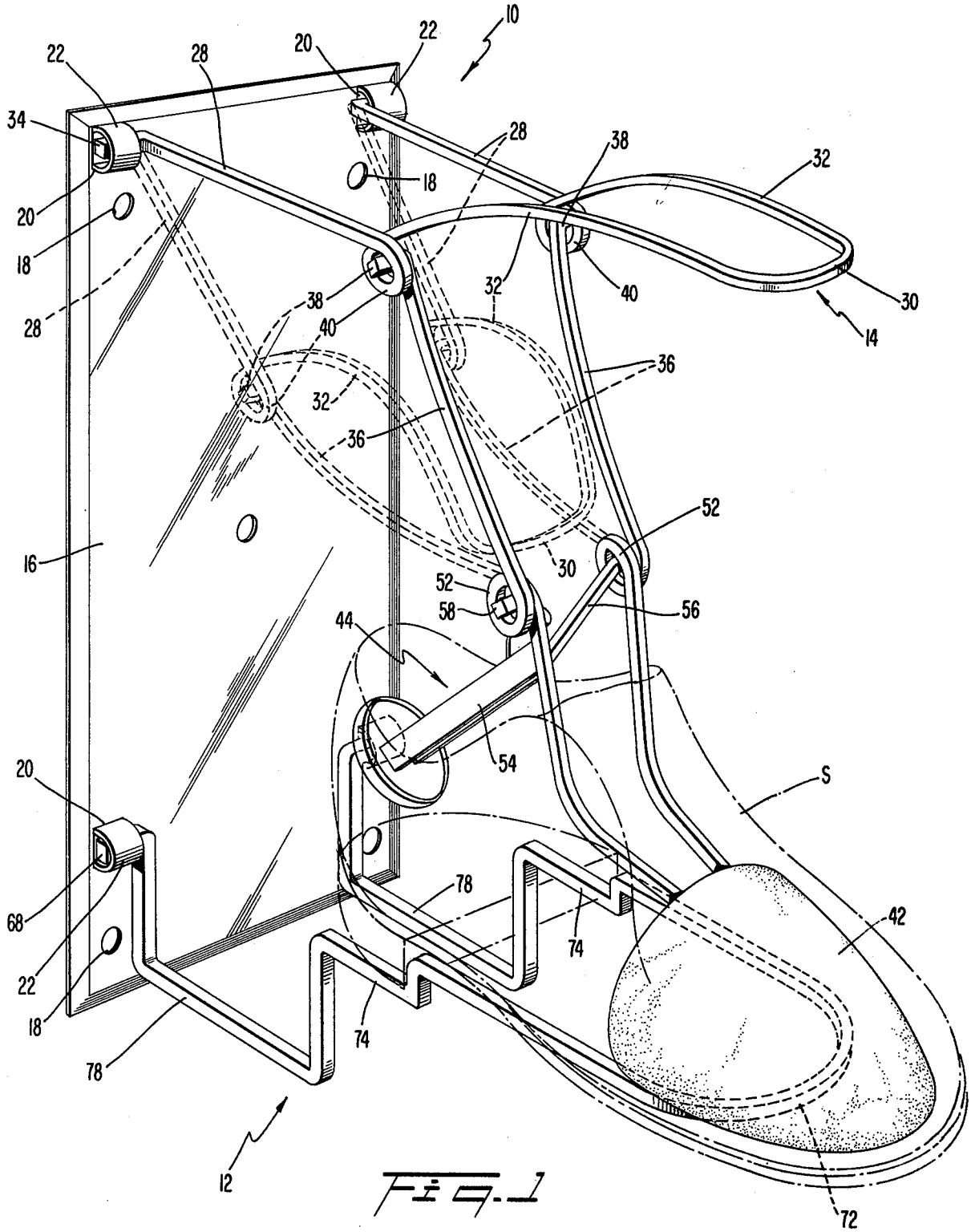
FIG. 1 is a perspective view of the shoe support apparatus constructed in accordance with the present invention and showing its cooperative parts within its erected state.

Referring now to the drawings, the shoe support apparatus of the present invention is generally indicated by the reference character 10. The apparatus is seen to include a shoe support member, generally indicated by the reference character 12, and a shoe retaining assembly generally indicated by the reference character 14. A substantially rectangular, planar base panel 16 is provided upon which support member 12 and retaining assembly 14 are pivotably mounted. As a result of such pivotable disposition of member 12 and assembly 14, the apparatus may selectively attain an erected operational mode or a collapsed storage mode, as disclosed in FIGS. 1 and 3, respectively.

Base panel 16 is provided with a plurality of apertures 18 located substantially within the corner and central portions thereof, and suitable fasteners, not shown, may be inserted therethrough. In this manner, panel 16 may be fixedly secured to a vertical support surface, not shown, such as, for example, a door or a wall.

In order to facilitate the pivotable mounting of member 12 and assembly 14 upon panel 16, a plurality of rectangular mounting apertures 20 are provided adjacent the corners. A plurality of U-shaped brackets 22 are operatively associated with the apertures 20, and as best seen in FIGS. 1 and 3. Upper and lower flanges 24 on the brackets (FIG. 3), may be secured, in any suitable manner, to the back of panel 16.

The retaining assembly 14 includes an upper supporting member or section with the rear portion being defined by laterally spaced arms 28 while the forward portion of the upper supporting member is defined by a U-shaped portion 30. The rear ends of arms 28 are provided with outwardly extending ears 34 adapted to be disposed within the upper pair of brackets 22 to form a pivot joint. U-shaped portion 30 is integrally connected to the forward ends of arms 28 by means of laterally spaced arcuate portions 32 with integrally formed loops 40. As a result of such structure, U-shaped portion 30 is disposed in a generally downwardly inclined mode so as to facilitate operation of the apparatus. That is, the lower, rounded nose of the U-shaped portion 30 serves as a convenient handle and assists in the locking operation limiting the over center movement, as will be seen later in detail.

The retaining assembly 14 further includes a lower supporting member upon which a shoe tree structure is supported. In order to properly dispose the shoe tree structure under operational conditions, the lower supporting member of the retaining assembly is pivotably suspended from the upper supporting member. The lower supporting member is defined by downwardly extending arms 36 having a generally curved configuration, as seen in FIGS. 1 and 3. The uppermost ends of arms 36 are integrally formed into outwardly extending ears 38 fitting within the loops 40 forming a pivot joint.

The shoe tree structure to be supported upon the retaining assembly is seen to comprise a conventional shoe tree toe member 42 and a shoe tree heel structure, generally indicated by the reference character 44. Toe member 42 is fixedly secured by clamp 46 to the lowermost ends of the arms 36, while heel structure 44 is pivotably secured to intermediate loops 52.

Heel structure 44 has a substantially Y-shaped configuration and is seen to comprise an elongated stem member 54 and support arms 56 integrally connected thereto. The free ends of arms 56 are provided with laterally outwardly extending ears 58 similar to ears 34 and 38. Ears 58 are adapted to be pivotally disposed within loops 52 to form a pivot joint, and in this manner, heel structure 44 is pivotably suspended as a part of the retaining assembly 14.

The shoe support member 12 takes the form of a substantially U-shaped metal rod, as may be seen from FIGS. 1 and 2, having a longitudinally stepped configuration. As a result of such structural characteristics, a shoe s (shown in phantom lines) is supported in an advantageous manner.

The rearmost ends of support member 12 are integrally formed into laterally outwardly extending ears 68. Ears 68 are similar to ears 34 and are adapted to be disposed within the lower pair of brackets 22. In this manner, brackets 22 serve as sockets for ears 68 whereby shoe support member 12 is pivotably supported adjacent the lower edge of the base panel 16.

The forward U-shaped section 72, serves to define a first, horizontally disposed planar platform for the sole of the shoe. The support member 12 is similarly defined immediately rearwardly of the first platform by means of offset section 74 to support the heel. As can be seen from FIG. 1, these planar platforms serve to support the shoe S thereon with an integral shoulder between preventing any tendency of the shoe to slide forward.

The rear portion of the support member 12 comprises a double offset section 78 as viewed in FIG. 1, which depends from the heel platform. As a result of this double offset structure, this rear section abuts the lower portion of base panel 16 when the support member 12 is positioned to its erected outwardly extending position, as shown. In this manner, support member 12 is furnished with a substantial amount of structural rigidity.

In utilizing the apparatus of the present invention, the apparatus may, for example, be initially disposed in its collapsed storage mode, as seen in FIGS. 2 and 3. In such mode, it is seen that shoe support member 12 is pivoted upwardly along said base panel 16 and out of the way. Similarly, the retaining assembly 14 has been pivoted downwardly, such that the same is disposed in an overlying relationship with respect to support member 12.

In order to erect the apparatus to its operative mode, the forward U-shaped portion 30 of the retaining assembly 14 is initially grasped and raised upwardly. This movement serves to raise the remainder of the assembly 14 having the shoe tree structure support thereon. When the entire retaining assembly 14 has been elevated, the shoe support member 12 is lowered to its horizontal support position. The shoe S may then be mounted upon shoe support member 12 with the sole and heel portions of the shoe being supported upon sections 72 and 74, respectively.

The shoe retaining assembly 14 is next pivotally manipulated such that the shoe tree structure thereof may be inserted within the shoe S. More particularly, the arms 28 and 36 are relatively moved so as to facilitate the insertion of shoe tree toe member 42 within the forward portion of shoe S. The shoe tree heel structure 44 may then be similarly manually guided so as to facilitate insertion within the heel portion of the shoe S.

When the shoe S is thus mounted upon the apparatus, it is additionally desirable to lock the apparatus in its erected state. In this manner, the apparatus can adequately support the shoe and advantageously resists the forces impressed upon the shoe during the performance of a shoe polishing operation. This function will now be described.

As may be appreciated from FIG. 1, when the apparatus is disposed in its erected state, an imaginary plane may be defined between the pivot joint comprising brackets 22 and ears 34 and the pivot joint comprising loops 52 and ears 58. While the apparatus is in the unlocked erected state, it is also noted that the pivot joint comprising loops 40 and ears 38 is disposed above such a plane.

If the pivot structure, defined by ears 38 and loops 40, is now moved in a generally downwardly and rearwardly direction so as to achieve the dashed line position shown in FIG. 1, such pivot structure will have traversed the imaginary plane. The nose of the U-shaped portion 30 comes to rest against the top of the arms 36 to complete the over-center locking relationship.

To release the locking relationship, the nose of upper support member is simply grasped and raised to bring the pivot joint of loop 40 and ear 38 back over-center, whereby the retaining assembly is released and the shoe S can be removed.

In conjunction with the over-center movement of the retaining assembly 14, the upper and lower supporting members necessarily undergo positional displacements. Such movements, in turn, impress forces upon the shoe tree to properly tension or stretch the shoe S. In this manner, the shoe is not only properly supported upon the apparatus, but is also stretched to facilitate application of polish and buffing of the shoe.

An important feature of my invention is the fabrication of the major parts of the apparatus from metal rod stock. In the preferred embodiment, the stock is ¼inch square steel rod providing desirable limited flexibility and resiliency. The pivot joints are formed of integral loops and bent ears making the assembly highly economical to manufacture.

When a shoe S is in place and the retaining assembly 14 is in the over-center locked position, the entire apparatus holds the shoe S securely by a combination of support forces. The shoe support member 12 holds the shoe S from underneath with the heel retained by the shoulder. On the top and inside, the shoe S is urged downwardly and forwardly. The forces acting together in this way give holding results that are superior to that previously obtained with my previous devices.

The limited flexibility of the arms 36 of the lower support member aid the over-center snapping movement. The rod material has sufficient memory to return to the original shape when the retaining assembly is released.

The ability to flex the parts also allows the pivot joints to be disconnectable to allow easy assembly and disassembly of the apparatus. For example, the arms 28 can simply be grasped and squeezed inwardly. The ears 34 can then, as desired, engage or disengage the brackets 22 of the base panel 16. As will be clear, the release or engagement at the other pivot joints is effected in the same easy manner.

The shoe tree structure is designed to fit into shoes of varying size. Because of the flexibility of the parts and the over-center locking system, a relative wide range of the sizes may be automatically accommodated. For example, on larger shoes than shoe S shown, the shoe tree structure simply fits further down into the shoe. Once the pivot joint is snapped over-center, the shoe regardless of size is held securely.

In summary, an improved shoe support apparatus 10, which is particularly useful for the performance of shoe polishing operation, has been disclosed. The apparatus is able to be readily disposed in a collapsed state for storage purposes or erected to an operational state. The apparatus further includes an over-center locking mechanism for locking the same in its erected state. In this manner, a range of shoes may be disposed upon the apparatus, properly stretched and rigidly supported so as to facilitate the performance of the shoe polishing operation. The apparatus includes parts fabricated of rod stock with integral pivot joints that are easily engaged and disengaged.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

What is claimed is:

1. Shoe support apparatus comprising:

base means adapted to be vertically positioned;

shoe support means on said base means for supporting a shoe;

shoe retaining means on said base means for entering and retaining said shoe in an upright position upon said shoe support means;

said shoe support means and said shoe retaining means being pivotably supported on said base means so as to be capable of being alternatively disposed either in a collapsed positioned adjacent the base means or on erected position; and said shoe retaining means includes a plurality of members pivotally interconnected, said shoe support means being pivotally mounted for upward movement adjacent the lower portion of said base means;

said shoe retaining means being pivotally mounted for downward movement adjacent the upper portion of said base means;

said shoe retaining means being disposed in an overlying relationship with respect to said shoe support means when disposed in said collapsed position, and means for locking said retaining means in erected position.

2. Shoe support apparatus as set forth in claim 1, wherein:

said locking means includes an over-center locking arrangement.

3. Shoe support apparatus as set forth in claim 1, wherein:

the pivotal joints of said plurality of members are integrally formed with said members.

4. Shoe support apparatus as set forth in claim 1, wherein:

said plurality of members are fabricated of metal rod stock.

5. Shoe support apparatus as set forth in claim 4, wherein:

said shoe support means has a stepped configuration so as to properly support the sole and heel portion of said shoe.

6. Shoe support apparatus as set forth in claim 2, wherein:

said shoe retaining means includes a shoe tree.

7. Shoe support apparatus as set forth in claim 6, wherein:

said shoe tree comprises a toe member and a heel member pivotally interconnected.

8. Shoe support apparatus comprising:

base means;

shoe support means on said base means for supporting a shoe;

shoe retaining means on said base means for retaining said shoe upon shoe support means;

said shoe support means and said shoe retaining means being pivotably supported on said base means so as to be capable of being alternatively disposed either in a collapsed or erected position; and said shoe retaining means includes a plurality of members pivotally interconnected and having a shoe tree with a toe member and heel member pivotally interconnected, said members include a first member having arm means extending outwardly from said base means, a second member connected by a first pivot joint to said first member, a second pivot joint between said toe member and said heel member of said shoe tree, over-center locking means for holding said retaining means in erected position, said overcenter arrangement being provided by relative movement of said pivot joints.

9. The shoe support apparatus of claim 8 wherein one member of said shoe tree is pivotally interconnected to said second member at said second pivot joint.

10. The shoe support apparatus of claim 9 wherein the over-center arrangement is provided at said first pivot joint, and effective to extend the toe and heel members at said second pivot joint to tension the shoe.

11. The shoe support apparatus of claim 10 wherein the arm means of said first member includes a first U-shaped rod means forming a handle portion extending outwardly from said first pivot joint to engage and disengage said second member.

12. The shoe support apparatus of claim 11 wherein said handle portion rests over-center on said second member to form said locking means.

13. The shoe support apparatus of claim 11 wherein said shoe support means includes a second U-shaped rod means extending outwardly from said base means, said first and second rod means having support ears, bracket loops on said base means to be engaged by said ears and said first and second U-shaped rod means having sufficient resiliency to be squeezed inwardly for flexing into said bracket loops for easy assembly and disassembly.

* * * * *